US006659739B2

(12) United States Patent
Varney et al.

(10) Patent No.: US 6,659,739 B2
(45) Date of Patent: Dec. 9, 2003

(54) LOCOMOTIVE AIR COMPRESSOR WITH AN ELECTRIC MOTOR SUPPORTED BY AN EXTERNAL BEARING

(75) Inventors: James M. Varney, Irwin, PA (US); Brian L. Cunkelman, Blairsville, PA (US); Walter E. Goettel, Monongahela, PA (US)

(73) Assignee: Westinghouse Air Brake Technologies Corporation, Wilmerding, PA (US)

( * ) Notice: Subject to any disclaimer, the term of this patent is extended or adjusted under 35 U.S.C. 154(b) by 0 days.

(21) Appl. No.: 10/236,817

(22) Filed: Sep. 6, 2002

(65) Prior Publication Data

US 2003/0091447 A1 May 15, 2003

Related U.S. Application Data

(63) Continuation-in-part of application No. 09/593,558, filed on Jun. 14, 2000, now abandoned.

(51) Int. Cl.[7] ..... F04B 35/04
(52) U.S. Cl. ..... 417/415; 417/372; 417/423.7
(58) Field of Search ..... 417/248, 360, 417/372, 415, 423.7; 310/90, 91

(56) References Cited

U.S. PATENT DOCUMENTS

| | | | | | |
|---|---|---|---|---|---|
| 860,826 | A | * | 7/1907 | Reavell | 417/248 |
| 1,786,595 | A | * | 12/1930 | Bischof | 417/415 |
| 3,280,751 | A | * | 10/1966 | Ekey | 417/423.7 |
| 4,170,058 | A | * | 10/1979 | Leffler | 310/90 |
| 5,741,124 | A | * | 4/1998 | Mazzucato et al. | 417/415 |
| 5,957,667 | A | * | 9/1999 | Epp | 417/372 |
| 6,376,950 | B1 | * | 4/2002 | Varney et al. | 310/91 |
| 6,447,267 | B1 | * | 9/2002 | Varney et al. | 417/360 |

* cited by examiner

*Primary Examiner*—Michael Koczo
(74) *Attorney, Agent, or Firm*—James Ray & Associates

(57) ABSTRACT

The present invention provides an externally mounted assembly for supporting a rotatable shaft member driven by an electric motor. The externally mounted assembly comprises an annularly projected bearing support member disposed on a substantially vertical plane and a bearing member mounted on the bearing support member. Such bearing member is connectable with the rotatable shaft member for supporting such rotatable shaft member thereby reducing extraneous vertical and horizontal movement of such rotatable shaft member while permitting such rotatable shaft member to rotate freely.

9 Claims, 2 Drawing Sheets

LOCOMOTIVE AIR COMPRESSOR WITH AN ELECTRIC MOTOR SUPPORTED BY AN EXTERNAL BEARING

CROSS REFERENCE TO RELATED APPLICATIONS

This application is a continuation-in-part of patent application Ser. No. 09/593,558 filed Jun. 14, 2000, now abandoned. The invention taught in this patent application is closely related to the invention taught in the following co-pending patent application, LOCOMOTIVE AIR COMPRESSOR WITH MOTOR SUPPORTED BY OUTSIDE BEARING, Ser. No. 09/593,559 filed Jun. 14, 2000. These patent applications are assigned to the same assignee and the teachings therein are incorporated into this application by reference thereto.

FIELD OF INVENTION

The present invention relates, in general, to an air-cooled multi-cylinder, two-stage air compressor and motor combination for a railway locomotive and, more particularly, the present invention relates to a crankshaft of such air compressor driven by an electric motor being supported by an external bearing.

BACKGROUND OF THE INVENTION

It is well known that multi-cylinder air compressors are used on freight and passenger locomotives to supply compressed air to the operating and control equipment of a railway air brake system. Many of these prior art air compressors have a pair of low-pressure cylinders and a high-pressure cylinder mounted on and supported by a crankcase in the usual manner and contain pistons which are actuated by connecting rods driven by a rotary crankshaft. One end of the crankshaft is coupled with and driven by a suitable rotatable prime mover, such as an electric motor. The other end of the crankshaft is keyed and thread ably attached by a locknut to the hub and wheel of a cooling fan assembly.

There are advantages of having the compressor directly driving the cooling fan. When the demand and speed of the air compressor increase, the speed and cooling capacity of the fan is proportionally increased. The fan can only stop turning when the compressor stops working or ceases to rotate. It has been found that the use of a separate electric motor for driving the cooling fan is unreliable since failure of the motor would result in the loss of the cooling effect and could allow the temperature of the rotating compressor to rise to dangerously high levels which could cause deterioration of the lubricating oil and could result in seizure of the air compressor.

The crankshaft driven by the electric motor does not, in prior art, have any support on the motor end of the shaft. This is the opposite end of the shaft from the fan. As the shaft rotates, in time, it may tend to vibrate and may possibly wobble. Any movement of the shaft, other than the rotatable movement which it is designed to have, may cause problems with the motor.

Proper operation requires that there be a space between the stator and the rotating portion of the motor. This space must be maintained. If the rotor contacts or rubs against the stator, problems with the motor may occur. On the other hand it is also important to keep the space between the stator and rotor to a minimum because as the space increases there is a loss of efficiency and of the power of the motor. Thus, the space is necessary but it must be kept as small as possible. When the shaft vibrates or wobbles it may cause the rotor to rub against the stator and, thus, adversely affect the motor.

SUMMARY OF THE INVENTION

The present invention provides an external mount assembly for supporting a rotatable shaft member driven by an electric motor. The external mount assembly comprises an annularly projected bearing support member being disposed in a substantially vertical plane and a bearing member secured on the bearing support member. Such bearing member is aligned with one end of a rotatable shaft member that is the opposite end of a rotatable shaft member connected to the hub and wheel of a cooling fan of such air compressor. Wherein the bearing member is used for supporting such rotatable shaft member thereby reducing extraneous vertical and horizontal movement of such rotatable shaft member while permitting such rotatable shaft member to rotate freely.

A second embodiment of the invention provides that in combination with a multi-cylinder two-stage air compressor in which an electric motor is used to drive a rotatable shaft member of said air compressor, there is an external mount for supporting the rotatable shaft member of the air compressor. Such external mount comprises an annularly projected bearing support member disposed in a substantially vertical plane and a bearing member secured on the bearing support member. Such bearing member is aligned with one end of a rotatable shaft member that is the opposite end of a rotatable shaft member connected to the hub and wheel of a cooling fan of such air compressor. Wherein the bearing member is used for securing the rotatable shaft member thereby reducing extraneous vertical and horizontal movement of the rotatable shaft member while permitting such rotatable shaft member to rotate freely.

OBJECTS OF THE INVENTION

It is, therefore, one of the primary objects of the present invention to provide a support for the crankshaft external to the motor housing in an air compressor/electric motor combination so as to reduce any vibration of the shaft.

It is also an object of the present invention to provide an outside support for the crankshaft in an air compressor/electric motor combination so as to reduce the possibility of the rotor rubbing against the stator.

An additional object of the present invention is to provide a support for the crankshaft in an air compressor/electric motor combination that is mounted on the housing of the electric motor.

These and various other objects and advantages of this invention will become apparent after a full reading of the following detailed description, particularly, when read in conjunction with the attached drawings as described below and the appended claims.

Figure 1:
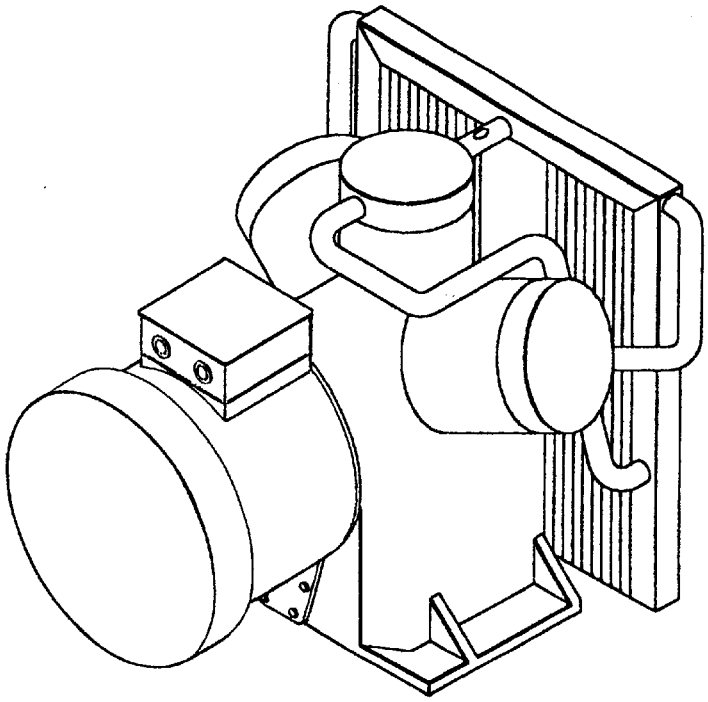
FIG. 1 PRIOR ART
FIG. 1 is an axonometric prior art drawing of a multi-cylinder, two-stage air compressor.

BRIEF DESCRIPTION OF THE PRESENTLY PREFERRED AND ALTERNATE EMBODIMENTS OF THE INVENTION

Prior to proceeding with the more detailed description of the present invention it should be noted that, for the sake of clarity, identical components, which have identical functions have been designated by identical reference numerals throughout the several views illustrated in the drawings.

Figure 2:
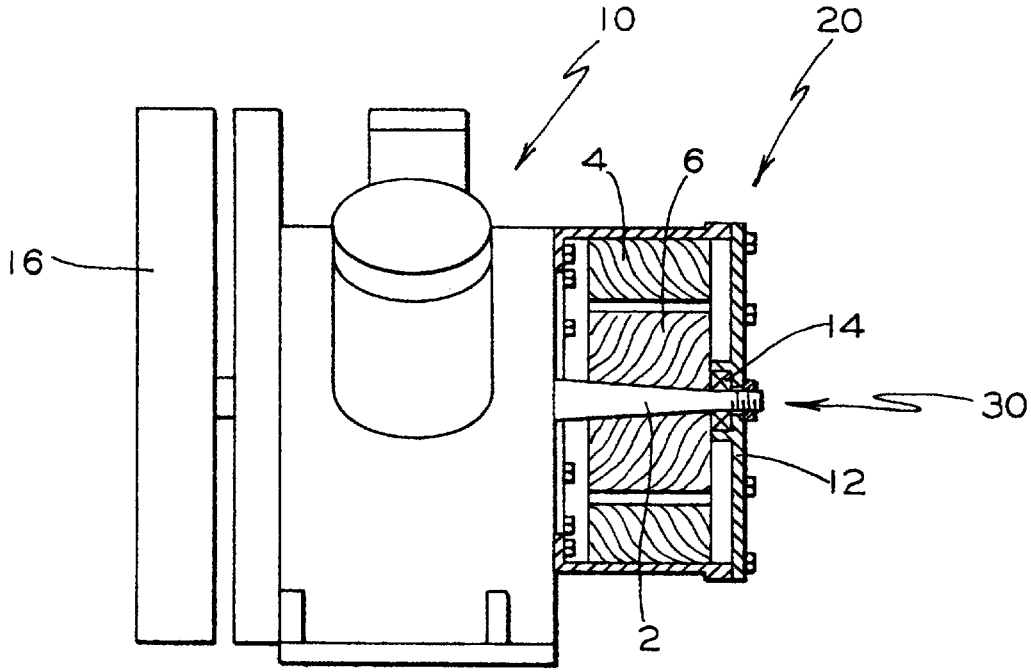
FIG. 2 is a block schematic diagram of an embodiment of the invention in combination with an inwardly projecting annular bearing support member, a multi-cylinder, and two-stage air compressor of the type shown in FIG. 1.
Figure 3:
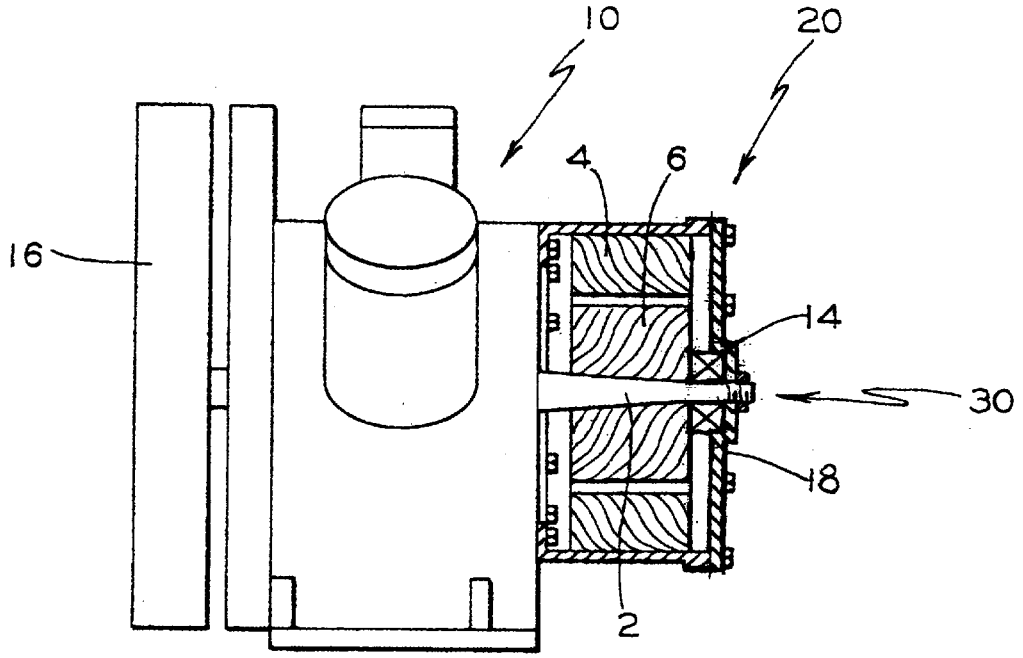
FIG. 3 is a block schematic diagram of an embodiment of the invention in combination with an outwardly projecting annular bearing support member, a multi-cylinder, and two-stage air compressor of the type shown in FIG. 1.
Figure 4:
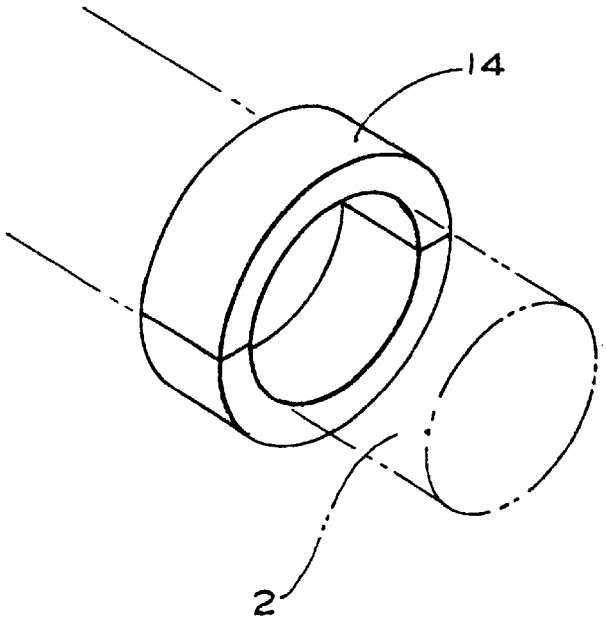
FIG. 4 is an axonometric drawing of a split type bearing according to an embodiment of the invention.

Reference is now made to FIGS. 2 and 3. Illustrated therein is a block diagram of the present invention in combination with a multi-cylinder, two stage air compressor, generally designated as 10, coupled with a predetermined electric motor, generally designated as 20. Such multi-cylinder, two-stage air compressor 10 contains pistons which are actuated by connecting rods driven by a rotary crankshaft 2. One end of the crankshaft 2 is to the hub and wheel of a cooling fan assembly 16. The other end of the crankshaft 2 is driven by a predetermined electric motor 20. Over a period of time the crankshaft 2 as it rotates may tend to vibrate or wobble. Any movement of the crankshaft 2 other than the rotatable movement which it is designed to have can create problems.

Proper operation of the motor requires that there be a space between the stator 4 and the rotor 6, which is the rotating portion of the motor. This space must be maintained. If rotor 6 comes into contact with or rubs against the stator 4, problems with the motor 20 may occur. It is also important that this space be kept to a minimum because as the space increases there is a loss of efficiency and of the power of the motor.

As is clearly evident FIG. 2 includes an inwardly projected annular bearing support member 12, which supports the bearing member 14. Also as is clearly evident, FIG. 3 includes an outwardly projected annular bearing support member 18, which supports the bearing member 14. As demonstrated in FIGS. 2 and 3, annular projecting bearing support members may be either inwardly or outwardly projected; however, it is presently preferred that such annular projection portions are inward. Further, it is seen that either of the annular projected bearing support members 12 or 18 have an aperture formed in them so as to permit such crankshaft 2 to protrude in case an extension is desired on the end of such crankshaft 2. This is true whether the bearing support member is a modified cover portion or a replacement part to replace the present cover. Such an aperture is disposed closely adjacent to a midpoint in the annularly projected bearing support members 12 and 18. The present invention provides an external support, generally designated 30, to support the crankshaft 2 and thus prevent or at least minimize any extraneous vertical or horizontal movement of the crankshaft 2. There is an upright bearing support member 12. A bearing member 14 is mounted on such upright annular projected bearing supports 12 or 18. Such bearing member 14 is connectable with the end of the crankshaft 2 that is opposite the end of the crankshaft that is connected to a hub and wheel of a cooling fan of such air compressor 10. Such bearing member 14 and such upright annular projected bearing support members 12 or 18 support the crankshaft thereby minimizing any extraneous movement of the crankshaft 2. Since the bearing member 14 freely rotates it does not impede any rotatable movement of the crankshaft 2. In an embodiment of the invention such bearing member 14 is a split bearing. It is also an embodiment of the invention that such bearing member 14 is connected to an outer end of such crankshaft 2.

The upright annular projected bearing support members 12 or 18 are connected to the motor housing that is presently used to enclose such motor 20. The connection may be made by modifying the cover portion of such housing such that the bearing member 14 can come in contact with and secure the crankshaft 2. However, it is within the scope of the invention that such upright annular projected bearing support members 12 or 18 may replace the present cover portion of the motor housing of such predetermined electric motor 20. Such external mount 30 may be included in new compressor assemblies and it may be retrofitted into air compressor units that are presently in use.

While both the presently preferred and a number of alternative embodiments of the present invention have been described in detail above it should be understood that various other adaptations and modifications of the present invention can be envisioned by those persons who are skilled in the relevant art of air compressor systems without departing from either the spirit of the invention or the scope of the appended claims.

We claim:

1. An assembly for supporting one end of a rotatable shaft member of a compressor driven by an electric motor, said assembly comprising:

a) a bearing support member secured to a housing for such electric motor, said bearing support member disposed substantially perpendicular to a longitudinal axis of such rotatable shaft member of such compressor, said bearing support member including an annular projecting portion; and b) a bearing member carried by said annular projecting portion of said bearing support member and engageable with such one end of such rotatable shaft member of such compressor for supporting such rotatable shaft member in a manner to thereby reduce extraneous vertical and horizontal movement of such rotatable shaft member while permitting such rotatable shaft member to rotate freely, said bearing member is connected to such one end of such rotatable shaft member that is opposite an end of such rotatable shaft member connected to a hub and wheel of a cooling fan of such air compressor.

2. An assembly for supporting a rotatable shaft member of a compressor driven by an electric motor, according to claim 1, wherein said bearing member is a split type bearing.

3. An assembly for supporting a rotatable shaft member of a compressor driven by an electric motor, according to claim 1, wherein said assembly is mounted externally to such motor housing.

4. An assembly for supporting a rotatable shaft member of a compressor driven by an electric motor, according to claim 1, wherein said bearing member further includes an aperture permitting said one end of said rotatable shaft member to protrude.

5. An assembly for supporting a rotatable shaft member of a compressor driven by an electric motor, according to claim 1, wherein said annular projecting portion projects inwardly towards said cooling fan.

6. In combination with a multi-cylinder two-stage air compressor in which an electric motor drives a rotatable shaft member of said air compressor, the improvement comprising an external assembly mounted to said electric motor for supporting one end of said rotatable shaft member of said air compressor, said external assembly mounted to said electric motor including:

a) a bearing support member secured to a housing for said electric motor, said bearing support member disposed substantially perpendicular to a longitudinal axis of said rotatable shaft member of said compressor, said bearing support member including an annular projecting portion; and b) a bearing member carried by said annular projecting portion of said bearing support member and engageable with said one end of said rotatable shaft member of said compressor for supporting said rotatable shaft member in a manner to thereby reduce extraneous vertical and horizontal movement of said rotatable shaft member while permitting said rotatable shaft member to rotate freely, said bearing member is connected to said one end of said rotatable shaft member that is opposite an end of said rotatable shaft member connected to a hub and wheel of a cooling fan of said air compressor.

7. A combination of a multi-cylinder two-stage air compressor and an external assembly mounted to said electric motor for supporting a rotatable shaft member driven by an electric motor, according to claim 6, wherein said bearing member is a split type bearing.

8. A combination of a multi-cylinder two-stage air compressor and an external assembly mounted to said electric motor for supporting one end of a rotatable shaft member driven by an electric motor, according to claim 7, wherein said bearing support member further includes an aperture permitting said one end of said rotatable shaft member to protrude.

9. A combination of a multi-cylinder two-stage air compressor and an external assembly mounted to said electric motor for supporting one end of a rotatable shaft member driven by an electric motor, according to claim 7, wherein said annular projecting portion projects inwardly towards said cooling fan.

* * * * *